United States Patent [19]

Sugiyama et al.

[11] Patent Number: 4,673,551

[45] **Date of Patent: * Jun. 16, 1987**

[54] FIN STOCK MATERIAL FOR USE IN PLATE FIN HEAT EXCHANGER ADAPTED FOR SUPERHIGH PRESSURE SERVICE

[75] Inventors: Yoshihiko Sugiyama, Kasugai; Keizo Nanba; Michiki Hagiwara, both of Nagoya; Takeshi Aoki, Takatsuki; Shosuke Iwasaki, Hyogo; Tetsuo Abiko, Osaka, all of Japan

[73] Assignees: Sumitomo Light Metal Industries, Ltd., Tokyo; Sumitomo Precision Products Co., Ltd., Amagasaki, both of Japan

[ * ] Notice: The portion of the term of this patent subsequent to Mar. 11, 2003 has been disclaimed.

[21] Appl. No.: 709,002

[22] Filed: Mar. 7, 1985

[30] Foreign Application Priority Data

May 25, 1984 [JP] Japan ..... 59-104457

[51] Int. Cl.[4] ..... C22C 21/00

[52] U.S. Cl. ..... 420/535; 420/534

[58] Field of Search ..... 420/534, 535; 148/439, 148/440

[56] References Cited

U.S. PATENT DOCUMENTS 3,219,492 11/1965 Anderson et al. ..... 148/11.5 A
4,039,298 8/1977 Anthony et al. ..... 148/438
4,167,410 9/1979 Anthony et al. ..... 420/528

FOREIGN PATENT DOCUMENTS 55-95094 7/1980 Japan .
55-123996 9/1980 Japan .
317259 12/1956 Switzerland .
731285 6/1955 United Kingdom .

*Primary Examiner*—R. Dean
*Attorney, Agent, or Firm*—Flynn, Thiel, Boutell & Tanis

[57] ABSTRACT

Fin stock materials adapted for use in superhigh pressure service heat exchanger fabricated by brazing are made of aluminum alloys consisting essentially of, in weight percentages, 0.6 to 1.5% of Mn, 0.1 to 1.0% of Cu, 0.1 to 0.75% of Mg, and 0.05 to less than 0.30% of Si, and the balance being aluminum and incidental impurities, the Fe in said impurities being controlled up to 0.8%. The aluminum alloy fin stock materials contain optionally at least one component selected from the group consisting of 0.05 to 0.25% of Zr, 0.01 to 0.25% of Ti, 0.05 to 0.25% of Cr and 0.01 to 0.25% of V. The fin stock materials have a combination of advantageous properties, particularly a high prevention effect of excessive silicon diffusion of brazing materials into the fins, good strength and formability, whereby give good utility particularly in plate fin heat exchangers for use in superhigh pressure applications.

4 Claims, 2 Drawing Figures

FIN STOCK MATERIAL FOR USE IN PLATE FIN HEAT EXCHANGER ADAPTED FOR SUPERHIGH PRESSURE SERVICE

BACKGROUND OF THE INVENTION

The present invention relates to plate fin heat exchangers and more particularly to fin stock materials adapted for forming fins of superhigh pressure service heat exchangers which are assembled integrally by brazing.

Heretofore, AA 3003 alloy (throughout the specification, aluminum alloy numbers all represent Aluminum Association designation unless otherwise indicated) has been extensively used as fin stock material for plate fin heat exchangers constructed from aluminum alloys by brazing, because of its good brazability. However, in the case where the heat exchanger is designed for use under superhigh pressures of at least 55 kg/cm$^2$ G, the AA 3003 alloy can not give a satisfactory utility in the intended use because of insufficient tensile strength. Therefore, for use under such superhigh pressures, AA 3004 alloy has been used as fin stock material instead of the AA 3003 alloy. The AA 3004 alloy has a higher strength of approximately one and one-half times that of the AA 3003 alloy and exhibits a sufficient formability as fin stock material.

Fins made of the AA 3004 alloy are ordinary brazed at a temperature range of 580° to 610° C., using an aluminum-silicon brazing alloy with a silicon content of about 6.8 to 13 wt. %. Particularly, in cases of highly dense heat exchangers in which thicker and finely corrugated fins are incorporated with a view to enlarging their size and increasing their strength for higher pressure service, a very long time including preheating time will be required to uniformly heat all the parts to be brazed to the brazing temperature. Thus, in parts which are heated to the brazing temperatures in a relatively short time and are in contact with molten brazing alloy, the brazing alloy is placed in a liquid state for a longer time and in this time, an unfavorable excessive diffusion of silicon of the brazing material into the fins is apt to occur. As such silicon diffusion proceeds, the width of brazed joint will be progressively reduced or bonding strength will be seriously decreased. For example, in the practically used heat exchanger assemblies, the width of brazed joints is decreased to a level below 30% of the initial width of brazed joints and some assemblies can not withstand testing pressures and fracture or breakage occurs at the brazed joint portion.

Further, it has been well known that about 1% Mg contained in the AA 3004 alloy accelerates the above detrimental silicon diffusion.

Further, when brazing is carried out in a vacuum, the evaporation of Mg in fins is unavoidably caused and thereby even if Mg is present in the same level as in the AA 3004 alloy, significant strengthening effect can not be expected in fins having been subjected to vacuum brazing.

SUMMMARY OF THE INVENTION

It is an object of the present invention to provide an improved fin stock material eliminating the problems encountered in the conventional plate fin heat exchangers adapted for use in superhigh pressure services, particularly the detrimental and destructive strength-reduction in the brazed joints of AA 3004 alloy fin stock due to the above-mentioned excessive silicon diffusion into fins.

Another object of the present invention is to provide fin stock materials having a combination of good strength and formability well comparable to or superior to the AA 3004 alloy.

In view of the foregoing, various studies and attempts have been made and it was found that the foregoing problems and disadvantages can be overcome by using an aluminum alloy (1) or (2) having the composition specified below as fin stock material.

(1) An aluminum alloy consisting esentially of, in weight percentages, 0.6 to 1.5% of Mn, 0.1 to 1.0% of Cu, 0.1 to 0.75% of Mg, and 0.05 to less than 0.30% of Si, and the balance being aluminum and incidental impurities, Fe in said impurities being controlled up to 0.8%.

(2) An aluminum alloy consisting esentially of, in weight percentages, 0.6 to 1.5% of Mn, 0.1 to 1.0% of Cu, 0.1 to 0.75% of Mg, 0.05 to less than 0.30% of Si, and at least one component selected from the group consisting of 0.05 to 0.25% of Zr, 0.01 to 0.25% of Ti, 0.05 to 0.25% of Cr and 0.01 to 0.25% of V, and the balance being aluminum and incidental impurities, Fe in said impurities being controlled up to 0.8%.

DETAILED DESCRIPTION OF THE PREFERRED EMBODIMENTS

Figure 1:
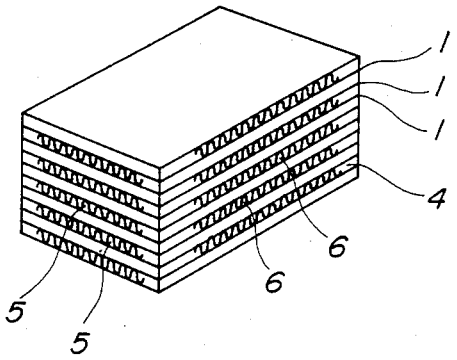
FIG. 1 is a perspective view showing a test assembly of heat exchanger incorporating fins according to the present invention by brazing.

In accordance to the present invention, there are provided fin stock materials made of the following aluminum alloy (1) or (2).

(1) An aluminum alloy consisting esentially of, in weight percentages, 0.6 to 1.5% of Mn, 0.1 to 1.0% of Cu, 0.1 to 0.75% of Mg, and 0.05 to less than 0.30% of Si, and the balance being aluminum and incidental impurities, Fe in said impurities being controlled up to 0.8%.

(2) An aluminum alloy consisting esentially of, in weight percentages, 0.6 to 1.5% of Mn, 0.1 to 1.0% of Cu, 0.1 to 0.75% of Mg, 0.05 to less than 0.30% of Si, and at least one component selected from the group consisting of 0.05 to 0.25% of Zr, 0.01 to 0.25% of Ti, 0.05 to 0.25% of Cr and 0.01 to 0.25% of V, and the balance being aluminum and incidental impurities, Fe in said impurities being controlled up to 0.8%.

Now, the function of each component specified above and reason why each component is limited to the aforesaid content range are described below in detail.

Mn: Mn has an effect of improving not only strength and corrosion resistance, but also brazability. Mn in an amount of less than 0.6 wt. % will not achieve sufficiently these effects. On the other hand, with a content of Mn more than 1.5 wt. %, an unfavorable coarse Al-Mn compound is formed, causing the lowering of rolling workability which makes fabrication of fins difficult.

Cu: Cu has an effect of improving strength. However, when the content of Cu is less than 0.1 wt. %, the effect can not be achieved. On the other hand, Cu in a content of more than 1.0 wt. % forms coarse intermetallic compounds and will adversely affect the resulting fin stock material.

Mg: Mg has a significant effect in increasing strength. However, when a content of Mg is less than 0.1 wt. %, the effect can not be achieved, while Mg in a content of more than 0.75 wt. % combines with Si of the brazing material to form $Mg_2Si$, whereby reducing remarkably the concentration of Si in the brazing material and resulting in a considerable lowering of brazability.

Si: Si has an effect of increasing strength in combination with Mg and, further, since Si in the fin reduces the Si concentration gradient between the fin and the brazing alloy, an excessive diffusion of Si contained in a brazing material into the fin is effectively suppressed. When Si is present in an amount of less than 0.05 wt. %, the above effects will not be attained. On the other hand, with Si of 0.3 wt. % or more, melting point is decreased to an unacceptable level.

Fe: Fe is one of several impurities and an excess content thereof should be avoided. However, Fe of 0.8 wt. % or less improves the strength and buckling resistance at elevated temperatures depending upon its content without substantially adversely affecting the resulting stock.

Further, the second fin stock material of the present invention contains in addition to the first fin stock materials at least one component selected from the group consisting of Zr, Ti, Cr and V in the respectively specified amounts.

Zr: Zr has an effect of improving strength, more particularly, the strength at an elevated temperature, and buckling resistance. Particularly, the buckling resistance is a very important factor, since fin stocks are brazed at the brazing temperature just below the melting point of the fin under the application of a load. When the content of Zr is less than 0.05 wt. %, the effect will not be achieved, and when the content exceeds 0.25 wt. %, undesirable coarse intermetallic compounds are formed during casting, lowering the properties of the fin stock.

Ti: Ti has an effect in refining the structure of the ingot and preventing the formation of coarse grain, whereby improving the strength. However, when Ti is less than 0.01 wt. %, the effect can not be obtained. On the other hand, Ti of more than 0.25 wt. % will cause surface defects of the aluminum alloy fin stock material.

Cr and V: Cr and V have an effect of improving strength in the above specified content range. When contents of these components are below the respective lower limits set forth above, the effect will not be obtained. On the other hand, Cr and V in amounts of more than the upper limits form coarse intermetallic compounds and result in defective surface.

The present invention will now be described in detail by referring to preferred embodiments and comparative examples which follow.

EXAMPLE

In Table 1 below, alloy compositions for fin stock materials according to the present invention are given together with AA 3003 and AA 3004 alloy compositions as comparative examples.

TABLE 1

| Alloy No. | Chemical Composition (wt. %) | | | | | | | | | |
|---|---|---|---|---|---|---|---|---|---|---|
| | Mn | Cu | Mg | Si | Fe | Zr | Ti | Cr | V | Al |
| 1 | 1.35 | 0.21 | 0.72 | 0.28 | 0.12 | total content of Zr, Ti, Cr and V <0.01 | | | | bal. |
| 2 | 1.10 | 0.42 | 0.35 | 0.18 | 0.17 | total content of Zr, Ti, Cr and V <0.01 | | | | " |
| 3 | 1.05 | 0.70 | 0.41 | 0.15 | 0.23 | total content of Zr, Ti, Cr and V <0.01 | | | | " |
| 4 | 0.72 | 0.90 | 0.15 | 0.07 | 0.45 | total content of Zr, Ti, Cr and V <0.01 | | | | " |
| 5 | 1.03 | 0.45 | 0.33 | 0.12 | 0.21 | 0.15 | 0.05 | <0.01 | <0.01 | " |
| 6 | 0.78 | 0.71 | 0.43 | 0.19 | 0.18 | <0.01 | 0.10 | 0.07 | <0.01 | " |
| 7 | 1.21 | 0.31 | 0.52 | 0.21 | 0.24 | 0.10 | <0.01 | <0.01 | 0.08 | " |
| 8 | 1.12 | 0.38 | 0.71 | 0.27 | 0.31 | 0.17 | <0.01 | <0.01 | <0.01 | " |
| 9 (AA 3003) | 1.15 | 0.15 | 0.01 | 0.23 | 0.58 | <0.01 | 0.01 | <0.01 | <0.01 | " |
| 10 (AA 3004) | 1.15 | 0.15 | 1.15 | 0.15 | 0.39 | <0.01 | 0.05 | <0.01 | <0.01 | " |

Nos. 1 to 8: Alloys of the fin stock materials in accordance to the present invention
Nos. 9 and 10: Alloys of the comparative fin stock materials Test specimens, 0.5 mm in thickness and 70 mm×70 mm in size, were prepared from the respective alloys shown in Table 1 above and brazing material (Al-10% Si- 1.5% Mg designated as AA 4004 alloy) having a diameter of 15 mm and a thickness of 1.5 mm was placed on each specimen. Thereafter, a spreading test was carried out on each test specimen by heating to 600° C. for 4 hours in a high degree of vacuum of $2\times10^{-5}$ mmHg and the maximum diffusion depth of the brazing material into each test specimen was examined.

Following the above test, in order to examine tensile strength, tensile testing was conducted on each test specimen having been heated in a high vacuum of $2\times10^{-5}$ mmHg at 600° C. for 4 hours.

The results of the above tests are shown in Table 2.

TABLE 2

| Alloy No. | Maximum Diffusion Depth of Brazing Material into each Test Specimen (μm) | Tensile Strength after High Temperature Exposure (600 ° C. × 4 Hr.) in a High Vacuum (kg/mm²) |
|---|---|---|
| 1 | 80 | 15.2 |
| 2 | 43 | 16.0 |
| 3 | 85 | 16.5 |
| 4 | 73 | 17.2 |
| 5 | 40 | 16.5 |
| 6 | 53 | 17.7 |
| 7 | 72 | 17.3 |
| 8 | 78 | 16.8 |
| 9 | 68 | 12 |
| 10 | more than 500 | 13 |

Figure 2:
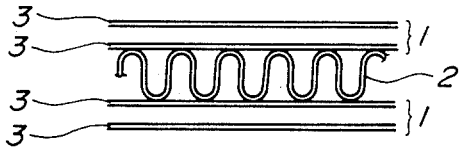
FIG. 2 is an enlarged elevational view of an important portion of the test assembly shown in FIG. 1.

Next, fins were prepared using the respective alloy materials given in Table 1 and then small-sized test assemblies of plate fin heat exchangers, shown in FIGS. 1 and 2, were fabricated incorporating the fins. FIG. 1 is a perspective view showing the test assembly and FIG. 2 is an elevational view of an important part and a perforation rate of 2.5%, and has seventeen fins of the test assembly. Plain type fin 2, which had a corrugation height of 6 mm, a plate thickness of 0.5 mm and perforation rate of 2.5%, and had seventeen fins per inch, was brazed between separator plates 1 made of brazing sheet having a brazing alloy layer 3 at 590° C. for 30 minutes under a pressure of $2\times10^{-5}$ mmHg. Reference numerals 4, 5 and 6 designate a spacer bar, a test fluid passage and a dummy fluid passage, respectively.

Ruptures due to internal pressure were examined on each test assembly thus fabricated using the fins made of the respective alloys shown in Table 1. The test results are indicated in Table 3 in which the fin numbers correspond to the alloy numbers given in Table 1, respectively.

TABLE 3

| Fin No. | Rupture Pressure (kg/cm$^2$ G) | First Ruptured Portion |
|---|---|---|
| 1 | 465 | Fin |
| 2 | 460 | Fin |
| 3 | 505 | Fin |
| 4 | 515 | Fin |
| 5 | 475 | Fin |
| 6 | 507 | Fin |
| 7 | 467 | Fin |
| 8 | 490 | Fin |
| 9 | 360 | Fin |
| 10 | 320 | Brazed Joint |

As can be clearly determined from Table 2, in the alloy of the fin stock materials in accordance to the present invention, silicon diffusion occuring during the brazing step is greatly reduced as compared to the case of AA 3004 alloy and the tensile strength after a high temperature exposure is much higher than in the AA 3004 alloy. It can be seen in Table 3 that the heat exchanger assemblies by brazing using improved fin stock according to the present invention exhibit a much higher strength at brazed portions well beyond the rupture strength at the fin portions and, thus, ruptures occur at the fin portions.

Even if the brazing material is placed in a liquid-phase state for a long time, the present fin stock materials of the present invention greatly suppress excessive silicon diffusion of the used brazing material into fin, whereby eliminating any unfavorable reduction in strength at the brazed joint caused during the brazing step for a long time.

Thus, the heat exchanger including the fins according to the present invention has a very high strength at both brazed joints and fin portions as compared with the conventional heat exchanger utilizing fins made of the AA 3004 alloy. Particularly, since the heat exchanger utilizing the fin stock of the present invention has a very high rupture pressure of at least 460 kg/cm$^2$ G, plate fin heat exchangers adapted for application at superhigh pressure, for example, up to over 90 kg/cm$^2$ G can be prepared by a brazing process, particularly, vacuum brazing, fluxless brazing in an inert gas atmosphere such as nitrogen.

What is claimed is:

1. A fin stock material for use in a plate fin heat exchanger fabricated by brazing, adapted for superhigh pressure service, said fin stock material being made of an aluminum alloy consisting essentially of, in weight percentages, 0.6 to 1.5% Mn, 0.1 to 1.0% Cu, 0.1 to 0.75% Mg, 0.05 to 0.25% Zr, 0.05 to less than 0.30% Si, up to 0.8% Fe, and the balance comprising aluminum and incidental impurities.

2. A fin stock material as claimed in claim 1 containing at least 0.15% Zr.

3. A fin stock material for use in a plate fin heat exchanger adapted for superhigh pressure service fabricated by brazing, said fin stock material being made of an aluminum alloy consisting essentially of, in weight percentages, 0.6 to 1.5% of Mn, 0.1 to 1.0% of Cu, 0.1 to 0.75% of Mg, 0.05 to 0.25% Zr, 0.05 to less than 0.30% of Si, up to 0.8% Fe, at least one component selected from the group consisting of 0.01 to 0.25% of Ti, 0.05 to 0.25% of Cr and 0.01 to 0.25% of V, and the balance being aluminum and incidental impruities.

4. A fin stock material as claimed in claim 3 containing at least 0.15% Zr.

* * * * *